US006786774B2

(12) United States Patent
Haas, II et al.

(10) Patent No.: US 6,786,774 B2
(45) Date of Patent: Sep. 7, 2004

(54) TWO-CONDUCTOR CABLE AND PHONE PLUG ASSEMBLY

(75) Inventors: Paul C. Haas, II, Plainwell, MI (US); Robert P. Ganger, Sturgis, MI (US)

(73) Assignee: G & H Industries, Centreville, MI (US)

( * ) Notice: Subject to any disclaimer, the term of this patent is extended or adjusted under 35 U.S.C. 154(b) by 0 days.

(21) Appl. No.: 10/463,895

(22) Filed: Jun. 18, 2003

(65) Prior Publication Data

US 2003/0207620 A1 Nov. 6, 2003

Related U.S. Application Data

(62) Division of application No. 10/123,371, filed on Apr. 16, 2002, now Pat. No. 6,609,937.

(60) Provisional application No. 60/284,099, filed on Apr. 16, 2001.

(51) Int. Cl.[7] ..... H01R 9/05; H01R 24/04

(52) U.S. Cl. ..... 439/669

(58) Field of Search ..... 439/669, 668, 439/578–585, 98, 610

(56) References Cited

U.S. PATENT DOCUMENTS

| | | | | |
|---|---|---|---|---|
| 2,878,459 A | | 3/1959 | Barker | |
| 4,018,501 A | | 4/1977 | Maloof | |
| 4,037,319 A | | 7/1977 | Maloof | |
| 4,325,599 A | | 4/1982 | Feldman | |
| 4,335,930 A | | 6/1982 | Feldman | |
| 5,176,536 A | | 1/1993 | Ganger et al. | |
| 5,238,422 A | | 8/1993 | Scherer | |
| 5,290,179 A | | 3/1994 | Weingartner | |
| 5,466,167 A | | 11/1995 | Scherer | |
| 5,895,294 A | | 4/1999 | DeLangis et al. | |
| 5,911,601 A | | 6/1999 | Weingartner | |
| 6,116,955 A | * | 9/2000 | Lazaro, Jr. | 439/610 |
| 6,146,196 A | | 11/2000 | Burger et al. | |
| 6,149,469 A | | 11/2000 | Kim | |
| 6,193,559 B1 | | 2/2001 | Weingartner | |

* cited by examiner

*Primary Examiner*—Gary F. Paumen
(74) *Attorney, Agent, or Firm*—Flynn, Thiel, Boutell & Tanis, P.C.

(57) ABSTRACT

An apparatus and method for producing a phone plug assembly utilizes a shielded or two-connecter cable. A conductive tip is concentrically received in an insulator. One conductor of the cable electrically connects to a stem of the tip. The other conductor of the cable electrically connects to a conductive sleeve that concentrically receives a portion of the insulator. When a shielded cable is utilized with the phone plug assembly, an exposed section of a conductive shield can receive a metal band or metal tape. The sleeve is crimped about the metal band or metal tape to provide the electrical connection between the sleeve and the exposed section of the conductive shield. The conductive shield can also be folded back about a cable jacket and received within a portion of the sleeve. The sleeve is then crimped in alignment with the folded exposed section to enhance the electrical connection. For use with a two-connector cable, a metal band or metal tape can extend about an exposed conductor and the adjacent insulated conductor connected to the tip. The sleeve is then crimped at the metal band or metal tape to enhance the electrical connection. Instead of a metal band, a cable adapter can provide a connection between the sleeve and an exposed conductor. The cable adapter includes an aperture for a conductor passing through and a groove at an outer surface for receiving a second conductor having an exposed section. When the adapter is inserted in the sleeve, the exposed conductor contacts the inner surface thereof.

12 Claims, 5 Drawing Sheets

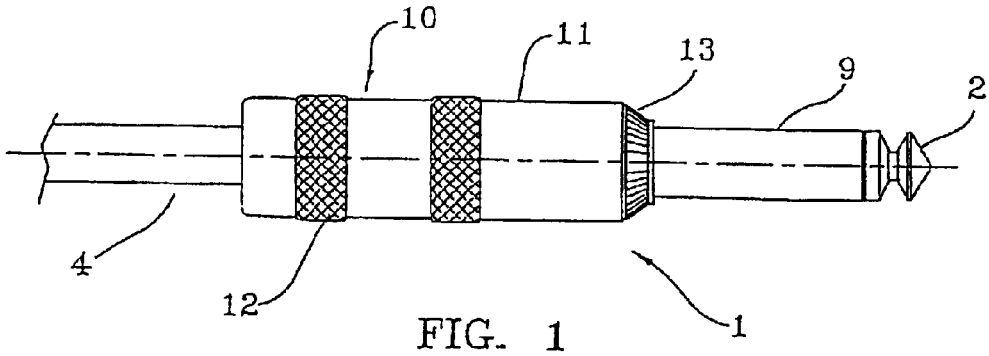
FIG. 1
FIG. 2
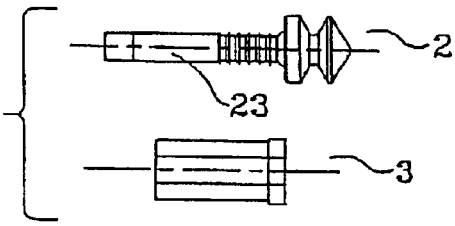
FIG. 3
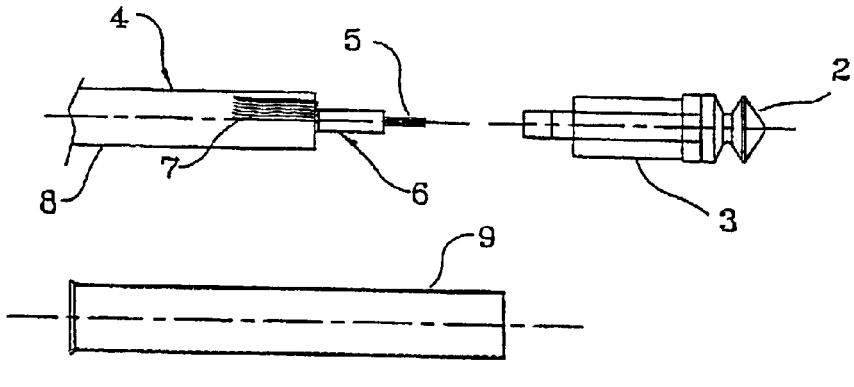
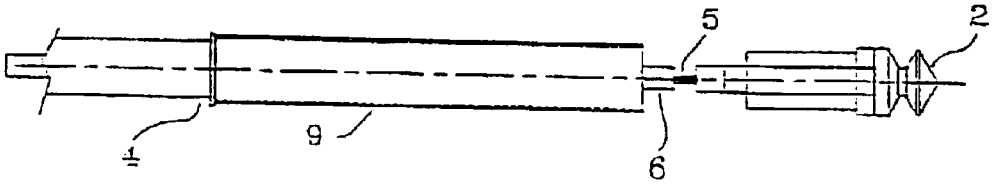
FIG. 4

TWO-CONDUCTOR CABLE AND PHONE PLUG ASSEMBLY

This is a division of Ser. No. 10/123,371, filed Apr. 16, 2002, now U.S. Pat. No. 6,609,937, which claims priority from Provisional Serial No. 60/284,099 filed Apr. 16, 2001.

FIELD OF THE INVENTION

This invention relates to a cable and phone plug assembly and a method for producing it.

BACKGROUND OF THE INVENTION

The phone plug is a common element of home, live entertainment and studio production systems. It is typically used for connecting audio from component to component.

Phone plugs are comprised of two electrically insulated parts. The tip typically carries the positive side of the circuit and the shield used for the ground.

DESCRIPTION OF RELATED PRIOR ART

U.S. Pat. No. 5,911,601 (Weingartner) discloses a Jack Plug whose housing is conductive and is an integral part of the tubular shaft 5 that fits over the sleeve 12. The housing is necessary for conduction and has grooves and this acts as a ground contact.

U.S. Pat. No. 5,290,179 (Weingartner) discloses a Jack Plug which has grooved threads for the housing. Its structure and method of making are very different from the G&H invention.

U.S. Pat. No. 4,335,930 (Feldman) discloses a Toolless Phone Plug wherein the braided shield of the outer coax cable is drawn into a pigtail 68. The insulated plug body received the braided pigtail in a slot 38.

None of the prior art discloses either the structure of the phone plug of this invention or the method of making it.

SUMMARY OF THE INVENTION

This invention provides a shielded or two-conductor cable and phone plug assembly comprising:

a. A tip;

b. A cable containing a conducting element, surrounded by an inner insulation, means for creating a ground connection consisting of a shield or a second insulated conductor, and cable jacket, wherein said conducting element terminates directly in the stem of said tip;

c. An insulator that is attached concentrically around the conducting element;

d. A sleeve that is attached concentrically around the insulator; and e. A housing that is attached concentrically around the sleeve.

Also provided is a shielded or two-conductor cable and phone plug assembly component comprising:

a. A tip;

b. A cable containing a conducting element, surrounded by an inner insulation, means for creating a ground connection consisting of a shield or a second insulated conductor, and cable jacket, wherein said conducting element terminates directly in the stem of said tip;

c. An insulator that is attached concentrically around the conducting element; and d. A sleeve that is attached concentrically around the insulator.

Further provided is a method for producing a shielded or two conductor cable and plug assembly comprising:

(1) stripping the cable and preparing the conducting element for termination to a tip;

(2) exposing the shield of the cable and folding it back over the cable jacket;

(3) inserting the stripped end of the cable into a sleeve and passing it through the sleeve;

(4) sliding the tip through a concentric hole in an insulator;

(5) terminating the conducting element directly to the stem of the tip;

(6) sliding the tip and insulator into the sleeve and affixing into place;

(7) crimping the sleeve to secure the cable within the sleeve and enhance the ground connection; and (8) sliding the housing over the sleeve and attaching the housing to the sleeve.

Still further provided is an audio phone plug assembly component comprising a cable containing a conducting element that terminates directly to a tip and an insulator that concentrically surrounds and is attached to the tip.

The method of this invention allows the production of a shielded cable or two-conductor cable and phone plug assembly at a rate of more than three times the rate of prior art methods. It also allows for direct termination of the conducting element 5 to the tip 2.

The method of this invention further allows the fabrication of a phone plug fully functional with the use of less parts. It does not require the use of a center clip, a ground clip, or some of the insulators that are required in a conventionally constructed plug. Further, the method of this invention allows more flexible assembly and results in a cable and phone plug assembly that provides better sound quality.

The term "cable" means an electrical transmission line.

The term "conducting element" means one or more conductors contained in a cable.

The term "tip" means the tip contact of a phone plug that fits into a phone jack. The tip stem is the end of the tip opposite the end that fits into the jack.

BRIEF DESCRIPTION OF THE DRAWINGS

FIG. 1 shows a perspective view of an embodiment of a shielded cable and phone plug assembly of this invention.

FIG. 2 shows a perspective view of the tip and insulator of an embodiment of the cable phone plug assembly of this invention.

FIG. 3 shows a perspective view of stripped shielded cable with the shield pulled back, the tip partially covered by the insulator, and the sleeve of an embodiment of the phone plug assembly of this invention.

FIG. 4 shows a perspective view of the conductor terminated to the tip and the sleeve fitted over the shielded cable of an embodiment of the cable and phone plug assembly of this invention.

REFERENCE NUMERALS IN DRAWINGS

Figure 5:
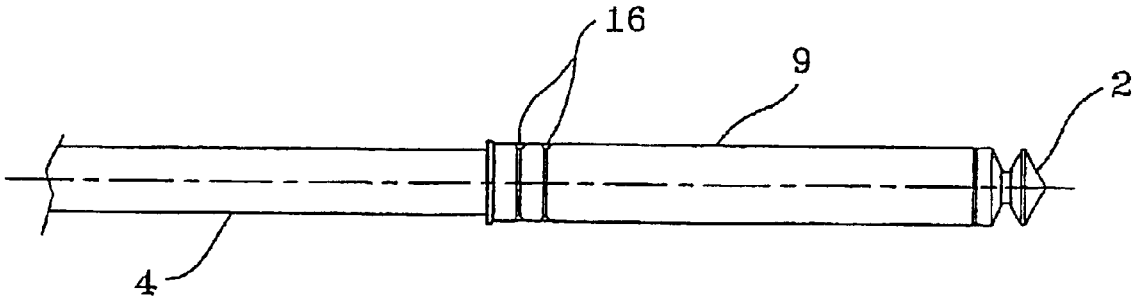
FIG. 5 shows a perspective view of terminated conductor and tip affixed to the sleeve and the sleeve affixed to the cable.

1 Audio phone plug
2 Tip
3 Insulator
4 Shielded cable
5 Conducting element
6 Inner insulation
7 Shield
8 Cable jacket
9 Sleeve
10 Housing
11 Housing wall
12 Diamond knurl
13 Straight knurl
14 Housing flange
15 Crimping tool
16 Crimp
17 Cable adaptor
18 External wall of cable adaptor
19 Internal wall of cable adaptor
20 Cable adaptor groove
21 Second insulated conductor
22 Exposed wire of second insulated conductor
23 Tip stem
24 Metal band
G Gap

DETAILED DESCRIPTION OF THE INTENTION

As shown in FIG. 1, an embodiment of the shielded cable and phone plug assembly 1 of the present invention comprises a tip 2, a coaxial cable 4 having a center conducting element 5 connected to the tip, an insulator 3 that concentrically surrounds a portion of the tip 2, a conductive sleeve 9 that concentrically surrounds the insulator and cable and a housing 10 that is concentrically affixed to the sleeve.

One method of making a shielded cable and phone plug assembly of this invention is as follows: The cable 4 is stripped in a step fashion to expose the center conductor 5 and shield 7. The shield is then folded back on the cable jacket 8 and the cable is passed through the sleeve 9 as shown in FIG. 3. If a two-conductor cable is used, the second insulated conductor 21 is stripped and a cable adaptor 17 is placed concentrically around the conducting element. The exposed wire 22 of the second insulated conductor is placed in cable adaptor grove 20 and the cable is passed through sleeve 9. After the cable is passed through the sleeve 9 and the insulator 3 fitted around the stem 23 of the tip 2, the center conductor 5 is fixed directly to the stem 23 of the tip 2, by staking, clamping, welding or soldering (See FIG. 4).

The tip 2 and insulator 3, after being affixed to the center conductor, are pushed or pulled into the axial inner diameter of the sleeve 9, or the sleeve 9 is moved over the insulator 3. After the tip 2 and insulator 3 are in place within the sleeve 9, the body of the sleeve can be crimped 16 to enhance the electrical contact between exposed wires 22 of the second insulated conductor 21 or the shield 7 of the cable to make a ground connection and to enhance the strength of it. The insulator and tip assembly can be affixed to the sleeve by press fitting, gluing, welding or crimping.

Figure 6:
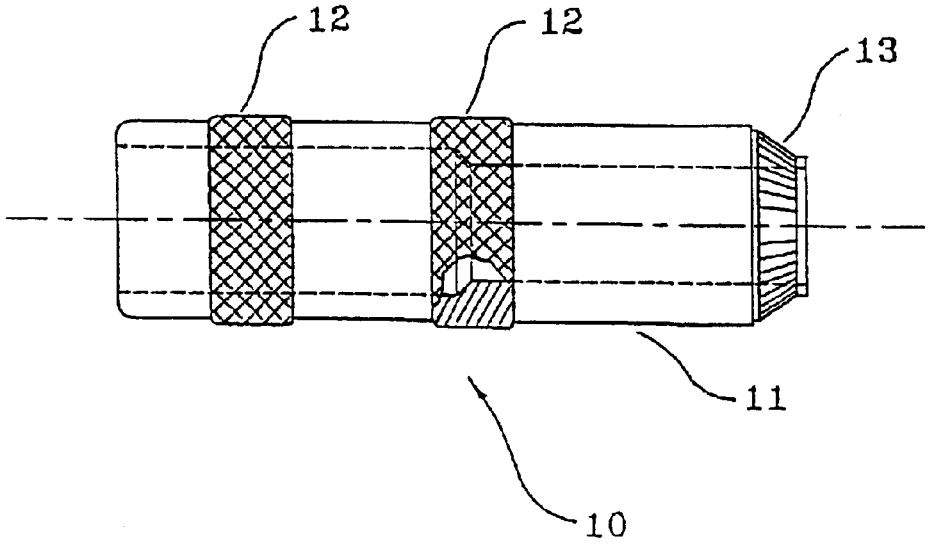
FIG. 6 Shows a perspective view of an embodiment of a housing that can be used with the cable and phone plug assembly of the invention.
Figure 7:
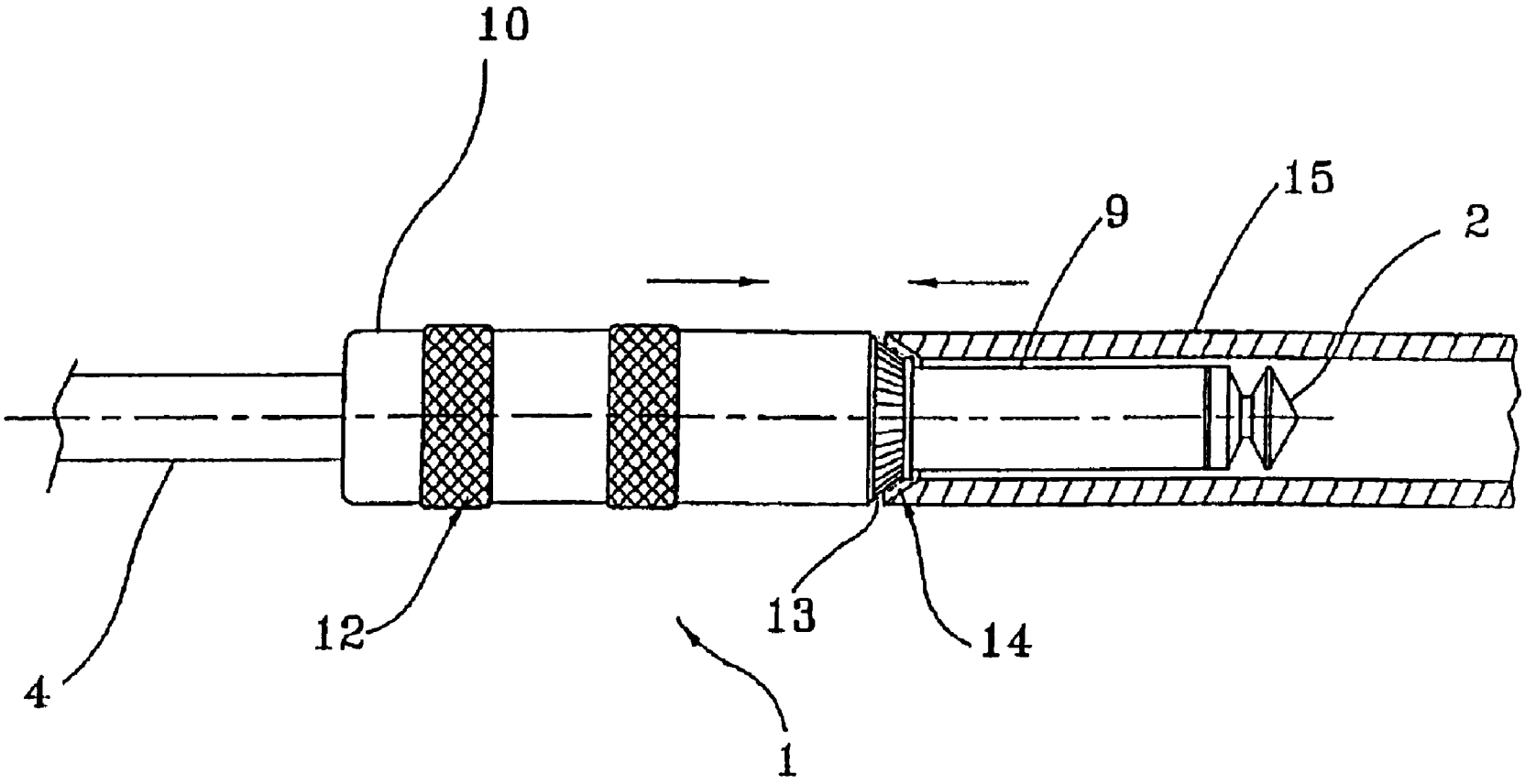
FIG. 7 shows a perspective view of the housing being affixed to the sleeve utilizing a crimping tool to make the inwardly facing housing flange of an embodiment of the phone plug assembly of this invention.

The housing 10 shown in FIG. 6 is placed over the tip 2, insulator 3 and sleeve 9 and affixed into place. This affixing can be done by methods well known in the art including, but not limited to, press fitting, gluing, welding and crimping. As shown in FIG. 7, in affixing by crimping, the housing flange 14 on the end of the housing closest to the tip is crimped inwardly around or about sleeve 9 by crimping tool 15 to seal the housing to it.

The shielded or two-conductor cable and phone plug assembly of this invention can be constructed from materials and parts that are either commercially available or that can be made by methods well known in the art.

Shielded cable is composed of a conducting element 5, surrounded by insulating dielectric material 6, a shield 7 comprising braided wire, spiraling wrapped wire or foil wrap which reduces interference from external sources and cable jacket 8. Two-conductor cable has a second separate insulated conductor that can be used to create the ground connection.

Figure 8:
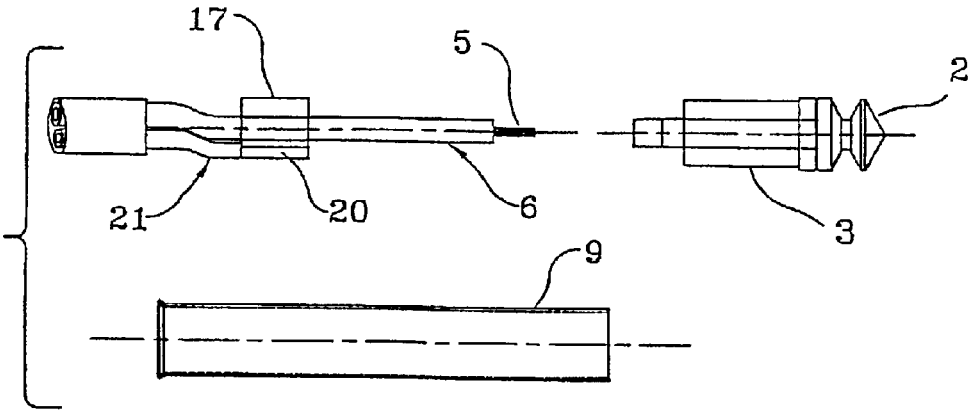
FIG. 8 shows a perspective view of a stripped two-conductor cable with the exposed second insulated conductor fitted into the grove of the cable adaptor, the tip partially covered by the insulator and the sleeve of an embodiment of the cable and phone plug assembly of this invention.
Figure 9:
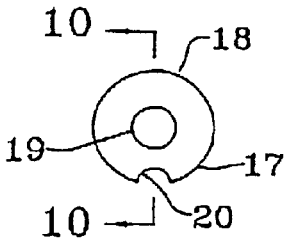
FIG. 9 shows a view of an embodiment of an adaptor that can be used as part of the ground connection with two-conductor cable.
Figure 10:
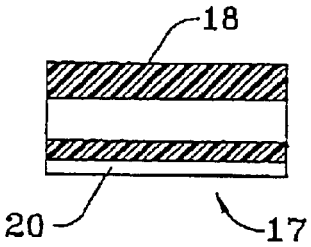
FIG. 10 shows a sectional view along line 10—10 of the cable adaptor

The use of cable having such a second insulated conductor in the method of this invention is illustrated in FIGS. 8–12. FIG. 8 shows second insulated conductor 21 that has been stripped to expose wire 22 (see FIG. 12). The exposed wire is secured by cable adaptor 17, shown in FIGS. 8–10, which is a tube defined by external wall 18 and internal wall 19. The exposed wire fits in groove 20 in the outside wall of the cable adaptor. The cable adaptor can be made of Nylon or other plastic material.

Figure 11:
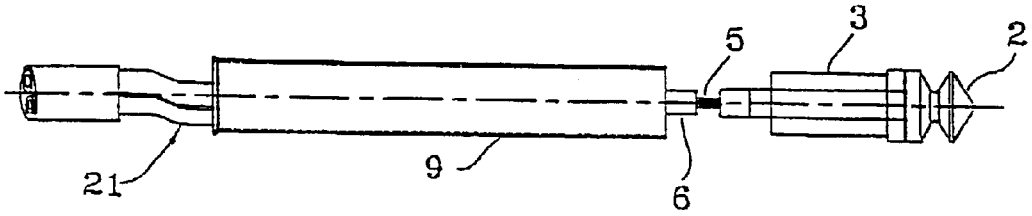
FIG. 11 shows a perspective view of the conducting element terminated to the tip and the sleeve fitted over the shielded cable of an embodiment of a two-conductor cable and phone plug assembly of this invention.
Figure 12:
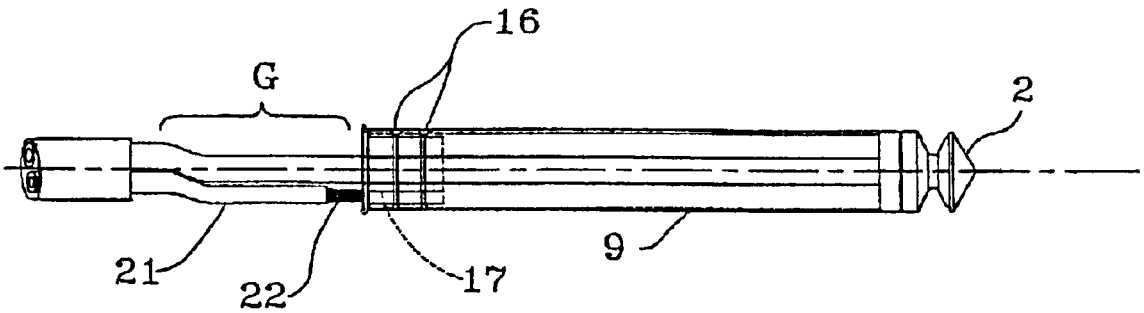
FIG. 12 shows a perspective view of the embodiment shown in FIG. 11 except the sleeve is fitted over the insulator at one end and crimped at the other end.

In the shielded cable embodiment of FIGS. 8–12, the conducting element 5 is connected to stem 23 of tip 2. The cable adaptor 17 is received within the conductive sleeve 9, as shown in FIG. 11. The sleeve 9 receives the insulator 3 at an outward end thereof. As shown in FIG. 12, the adaptor 17 is retained in sleeve 9. The sleeve 9 is crimped at or about the adaptor 17 to ensure an electrical connection with exposed wire 22.

The housing 10 is then secured to the sleeve 9 preferably at a first end. The second end of the housing extends across gap G shown in FIG. 12 and surrounds the cable jacket 8.

Figure 13:
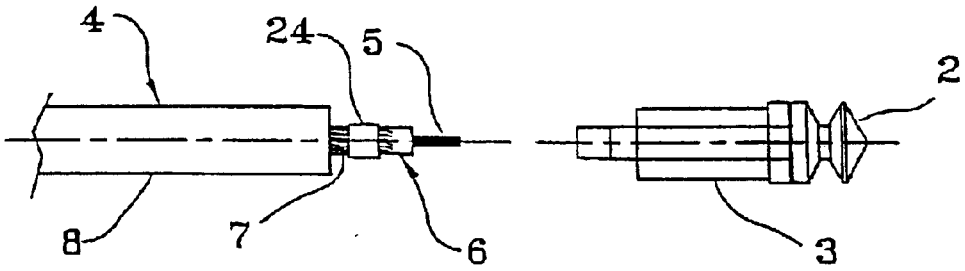
FIG. 13 shows a view of an embodiment having a metal band or metal tape secured about a shield.

FIG. 13 shows another embodiment for connecting the conductive shield 7 to the cylindrical conductive sleeve 9. In FIG. 13, the wire is stripped to expose conducting element 5, inner insulation 6 and conductive shield 7. However, instead of folding the shield 7 a metal band 24 is positioned thereabout. The metal band 24 then is crimped or otherwise secured to the shield 7. The metal band 24 is received in the metal sleeve 9, as in the earlier embodiments. The sleeve 9 is crimped or otherwise worked in alignment with the metal band to enhance the electrical connection between the band and sleeve.

While the embodiment of FIG. 13 shows the metal band 24 extending about the entire circumference of the shield 7, the band can also be utilized with the two conductor arrangement shown in FIGS. 8–12. In this embodiment, the adaptor 17 is replaced by the metal band 24. The metal band 24 receives therein the insulated conducting element 5 and the second insulator conductor 21 including exposed wire 22. The metal band 24 is crimped or otherwise secured against the elements 5, 21. The insulation 6 prevents the conductor 5 and exposed wire 22 from contacting each other. Even though the exposed wire 22 is not about the entirety of the first conductor 5, the metal band 24 provides enhanced electrical contact between the wire 22 and the sleeve 9.

In another embodiment of the invention, the metal band 24 is replaced with a metal tape. The metal tape is wrapped about the conductive shield 7 for a shielded cable or wrapped about the exposed wire 22 and conductive element with insulation 5, 6 for a two-conductor cable. The sleeve 9 is crimped or worked to ensure contact with the metal tape. The metal tape enhances electrical contact between the shield 7 or wire 22 and the sleeve 9.

The tip 2 can be made of any conducting material such as machined brass, copper or silver. This base material may be plated with material including, but not limited to, nickel, gold, silver and rhodium. The tip could also be made from conductive or non-conductive plastic with a suitable conductive coating.

The insulator 3 may be constructed of conventional insulation material used in the production of electrical connectors. For example, nylon, polyethylene, TEFLON.

The conducting element 5 can be part of shielded cable well known in the art. For example, the cable may be coaxial or have other configurations. It may contain varied inner conduction gauges, 28-16 gauge or more and up to 12 gauge for speakers. It may also have varied shield configurations, gauges and percent coverage as well as varied extruded jacket materials, thicknesses and diameters.

The sleeve 9 preferably is a metal tube or machined brass that has nickel, gold, silver or rhodium plating.

The housing 10 may be made in any configuration and of any material known in the art for constructing phone plugs such as machined brass, with or without having nickel, gold or silver plating; wood or plastic. This is possible because the construction of this phone plug assembly of this invention does not require the housing to add shielding. The housing, if required, is only for appearance or and ease of extracting the plug from the jack.

One embodiment of a housing is shown in FIG. 6. The housing consist of wall 11, two diamond knurls 12 and one straight knurl 13 and a flange 14 on the end that is attached to stem 9. It can be constructed of 7⁄16 360 Brass finished in bright nickel plating.

Although particular preferred embodiments of the invention have been disclosed in detail for illustrative purposes, it will be recognized that variations or modifications of the disclosed apparatus and method lie within the scope of the present invention

What is claimed is:

1. A two conductor cable and phone plug assembly comprising:

a conductive tip having a stem;

a cable comprising a first conductor including an insulation layer, a second conductor, and an outer cable jacket surrounding said first and second conductors, wherein said first conductor electrically connects directly to the stem of said tip;

an insulator secured concentrically around a portion of the tip;

a conductive sleeve that is secured concentrically around a portion of the insulator and receiving the first and second conductors therein without receiving said outer cable jacket, said conductive sleeve being electrically connected to a spliced section of said second conductor; and a housing that is secured concentrically around the sleeve, said housing extending across a gap between said sleeve and said outer cable jacket.

2. The two-conductor cable and phone plug assembly of claim 1, including a metal band extending about a portion of the spliced section of the second conductor and the first conductor, the metal band being received in the sleeve, wherein the conductive sleeve is crimped at the metal band to provide the electrical connection between the second conductor and the sleeve.

3. The two-conductor cable and phone plug assembly of claim 1, including metal tape wrapped about a portion of the spliced section of the second conductor and the first conductor, the metal tape being received in the sleeve, wherein the conductive sleeve is crimped at the metal tape to provide the electrical connection between the second conductor and the sleeve.

4. The two-conductor cable and phone plug assembly of claim 1, wherein one end of the sleeve is adjacent the tip and an opposing end of the sleeve is spaced from the outer cable jacket.

5. The two conductor cable and phone plug assembly of claim 1, including an insulating cable adaptor having a central aperture receiving the first conductor and a groove receiving an exposed end of the second conductor, the adaptor spacing the second conductor from the first conductor.

6. The two-conductor cable and phone plug assembly claim 1, wherein said stem is monolithic with said conductive tip.

7. The two-conductor cable and phone plug assembly claim 2, wherein said stem is monolithic with said conductive tip.

8. The two-conductor cable and phone plug assembly of claim 3, wherein said stem is monolithic with said conductive tip.

9. The two-conductor cable and phone plug assembly of claim 4, wherein said stem is monolithic with said conductive tip.

10. The two-conductor cable and phone plug assembly of claim 5, wherein said stem is monolithic with said conductive tip.

11. The two-conductor cable and phone plug assembly of claim 1, wherein the length of said insulator is less than the length of the stem of said tip so that said stem extends outwardly from said insulator.

12. The two-conductor cable and phone plug assembly of claim 1, wherein said first conductor is secured in said stem by soldering, welding, staking or clamping.

* * * * *